US006196767B1

(12) United States Patent
Thomas

(10) Patent No.: US 6,196,767 B1
(45) Date of Patent: Mar. 6, 2001

(54) JACK-UP PLATFORM HAVING A SUBMERGED TANK AND METHODS FOR INSTALLING AND RAISING THE TANK

(75) Inventor: Pierre-Armand Thomas, Puteaux (FR)

(73) Assignee: Technip Geoproduction, Paris la Defense Cedex (FR)

( * ) Notice: Subject to any disclaimer, the term of this patent is extended or adjusted under 35 U.S.C. 154(b) by 0 days.

(21) Appl. No.: 09/264,895

(22) Filed: Mar. 9, 1999

(30) Foreign Application Priority Data

Mar. 11, 1998 (FR) ..... 98 02987
Mar. 11, 1998 (FR) ..... 98 02988

(51) Int. Cl.[7] ..... E02B 17/08

(52) U.S. Cl. ..... 405/203; 405/195.1; 405/196; 405/205; 405/207; 405/210; 114/264; 114/265

(58) Field of Search ..... 405/195.1, 196, 405/197, 200, 203, 204, 205, 206, 207, 208, 209, 210, 211; 114/264, 265

(56) References Cited

U.S. PATENT DOCUMENTS

| | | | | |
|---|---|---|---|---|
| 2,953,904 | * | 9/1960 | Christenson | 405/196 |
| 3,385,069 | * | 5/1968 | Estes | 405/196 |
| 3,433,024 | * | 3/1969 | Diamond et al. | 405/196 |
| 3,727,414 | * | 4/1973 | Davies | 405/196 |
| 4,015,553 | * | 4/1977 | Middleton | 114/245 |
| 4,266,887 | * | 5/1981 | Corder | 405/196 |
| 4,347,798 | * | 9/1982 | Gallagher | 114/74 R |
| 4,380,406 | * | 4/1983 | Ayers | 405/203 X |
| 4,627,767 | | 12/1986 | Field et al. | 405/196 |
| 4,666,341 | * | 5/1987 | Field et al. | 405/203 X |
| 4,907,912 | * | 3/1990 | Smith | 405/208 |
| 5,299,521 | * | 4/1994 | Loucks | 114/219 |
| 5,833,396 | * | 11/1998 | Thomas | 405/196 X |
| 5,855,455 | * | 1/1999 | Williford et al. | 405/196 |
| 5,967,078 | * | 10/1999 | Eilert | 114/357 |
| 6,030,148 | * | 2/2000 | Tormala et al. | 405/196 |

FOREIGN PATENT DOCUMENTS

| | | |
|---|---|---|
| 1 173 704 | 3/1959 | (FR) . |
| 2 225 582 | 11/1974 | (FR) . |
| 2 247 910 | 5/1975 | (FR) . |
| 2 334 790 | 7/1977 | (FR) . |

* cited by examiner

*Primary Examiner*—Eileen D. Lillis
*Assistant Examiner*—Jong-Suk Lee
(74) *Attorney, Agent, or Firm*—Wenderoth, Lind & Ponack, L.L.P.

(57) ABSTRACT

A jack-up platform of the type having a buoyant upper barge (10) mounted so that it can be moved along the length of bearing legs (12), mechanical mechanism (18) for moving the legs (12) relative to the barge (10), and submerged storage tank (14) intended to rest on the bottom. The tank (14) has a lower opening (26) allowing the inside of the tank (14) to be placed in contact with the marine environment. The tank defines a bell-shaped/inverted U-shaped cavity confining an air bubble (30) in its upper part. The tank (14) is connected to the lower end of the legs (12) so that it can be moved relative to the barge (10) from the mechanical mechanism (18) for moving the legs.

21 Claims, 6 Drawing Sheets

JACK-UP PLATFORM HAVING A SUBMERGED TANK AND METHODS FOR INSTALLING AND RAISING THE TANK

BACKGROUND OF THE INVENTION

1. Field of the Invention

The present invention relates to a jack-up platform of the type comprising a buoyant upper barge mounted so that it can be moved along the length of bearing legs, mechanical means for moving the legs relative to the barge, and a submerged storage tank intended to rest on the bottom.

It furthermore relates to a method of installing a submerged tank of a jack-up platform of the aforementioned type and to a method of raising such a tank.

2. Description of the Related Art

Such types of platform are used for operating oil fields. What happens is that before the extracted oil is transported, for example by boat, as far as land, the submerged tank is used for its temporary storage.

It is known practice for this purpose to provide a large-capacity storage tank on which the legs of the jack-up platform rest.

In known platforms, the tank is generally made with concrete walls. It forms a footing on which the rest of the platform rests.

When installing the platform, the storage tank is floated out separately to the site where the platform is to be installed. It is then submerged by weighting it down by filling it with water taken from the sea.

When the tank is resting on the bottom, the barge of the platform bearing the legs is floated out to a location over the tank. The legs are then lowered until their lower end rest on the upper surface of the tank. The barge is then jacked up above the water level.

Such a method of installing a platform is effective and well mastered. However, in the case of platforms which have to be moved around the oil field a number of times during their life, the storage tank cannot be reused.

This is because as the tank is independent, it is extremely tricky and risky to re-float it.

Thus, each time the platform is moved to a new site, it is necessary initially to install a new tank. This considerably increases the cost of re-siting the platform.

Furthermore, abandoning the submerged storage tank once the upper barge has been re-sited is harmful to the environment.

SUMMARY OF THE INVENTION

The object of the invention is to propose a jack-up platform and a method of installing and uninstalling it, that allow the platform to be employed a number of times in turn at distinct locations, for a lower cost and with no impact on the environment.

To this end, the subject of the invention is a jack-up platform.

Another subject of the invention is a method of installing a submerged tank of a jack-up platform.

BRIEF DESCRIPTION OF THE DRAWINGS

The present invention will be better understood from reading the description which will follow, given solely by way of example and made with reference to the drawings in which.

DETAILED DESCRIPTION OF THE INVENTION

Figure 1:
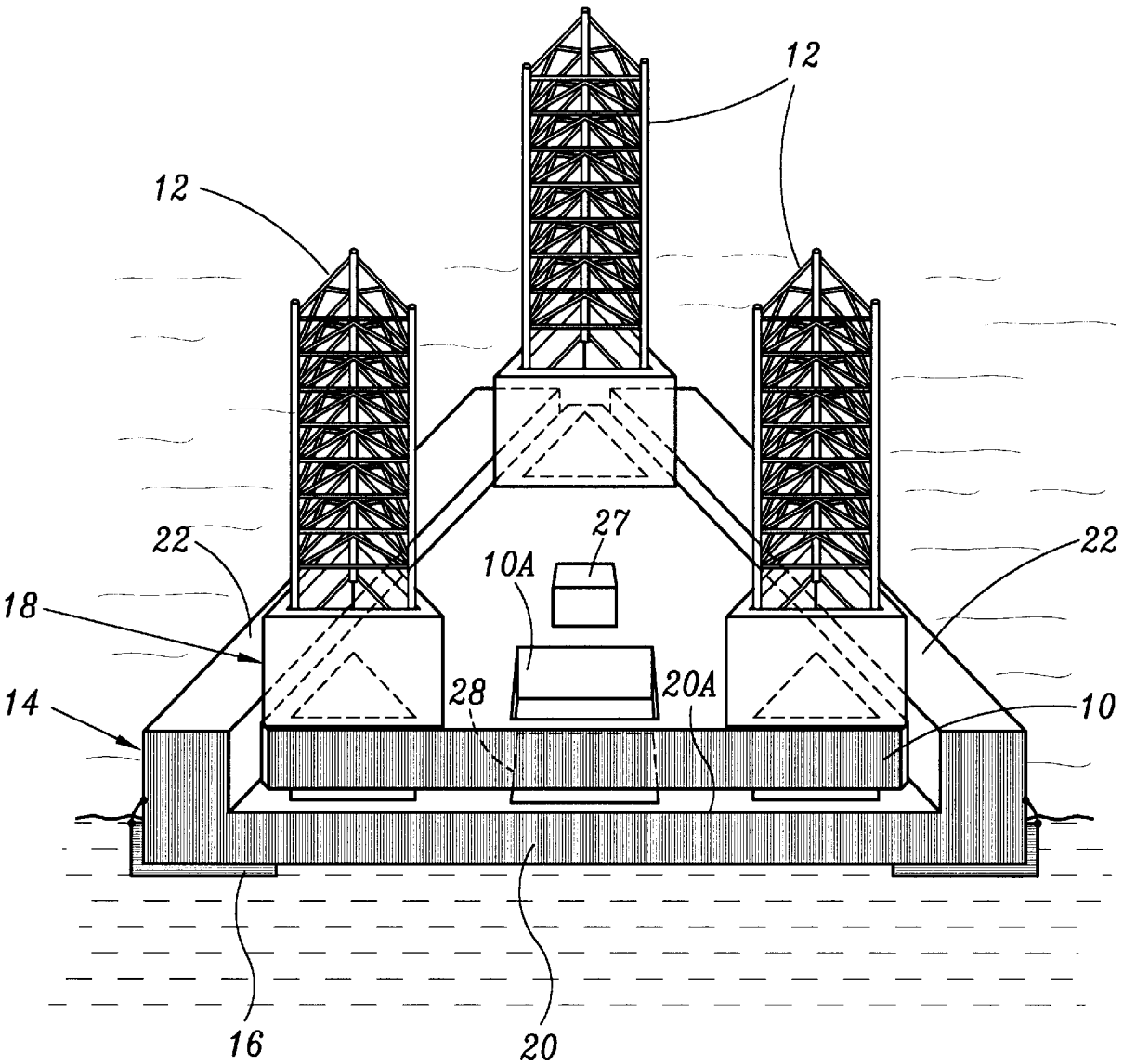
FIG. 1 is a three-quarter perspective view of a jack-up platform according to the invention, in a transport position.
Figure 2:
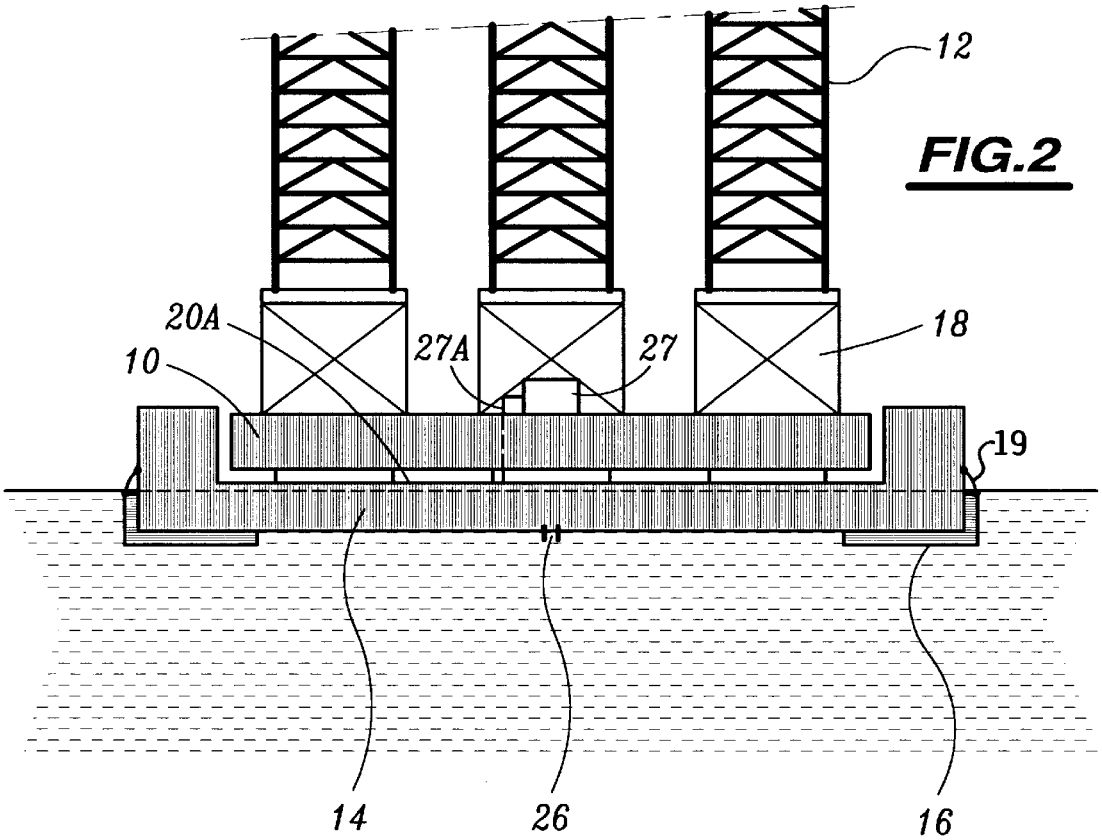
FIG. 2 is a view in elevation of the platform of FIG. 1, during transport.

The platform according to the invention, depicted in the transport position in FIGS. 1 and 2, comprises an upper barge 10 which is mounted so that it can be moved and so that its position can be adjusted on vertical legs 12. It further comprises a submerged storage tank 14 intended to rest on the bottom via bearing soles 16. After installation, the tank 14 with the soles 16 form a base 17 that supports the structure formed of the barge 10 and of the legs 12.

The barge 10 comprises a hermetically sealed caisson. It is fitted in the conventional way with production equipment and living quarters, and with a boring tower arranged above a transverse passage 10A. These are not depicted in the figures.

The barge has, for example, the shape of an equilateral triangle with sides 90 meters long.

The height of the barge is 10 meters. Its mass with the equipment it carries is about 25,000 t. The volume of the barge is about 40,000 $m^3$.

Furthermore, the barge 10 is equipped, for each leg 12, with a lifting mechanism 18. These mechanisms are designed to move the legs 12 relative to the barge 10, and in particular to lower the legs then raise the barge up above sea level after the legs have come to rest on the bottom of the sea. Likewise, these lifting mechanisms 18 are designed to allow the legs 12 and the tank 14 to be raised back up.

Each vertical leg 12 in this particular instance has a triangular cross section. It consists of three vertical chords connected together by a lattice of metal tubes. The lower end of each leg is welded to the upper surface of the tank 14.

The total mass of the legs is about 5000 t.

The tank 14 has the overall shape of an equilateral triangle. One of the apexes is truncated. Thus, the longest side of the tank is 120 m long, whereas the two sides which lead to the truncated apex are 95 m long.

The tank 14 is formed of a metal caisson. It has a base 20 with a surface area greater than that of the barge 10. This base is laterally flanked along two sides adjacent to the truncated apex by two upper rims 22 forming shields. These rims 22 delimit a triangular region 20A on the base 20, and this is for supporting the barge 10. This support region 20A has a surface area that slightly exceeds that of the barge 10. It is open along a side opposite the truncated apex of the tank.

The base 20 is 7 m thick. It has a vertical passage 28 passing through it for the oil production pipework.

The rims 22 forming shields are delimited by the metal caisson forming the tank. Thus, within their thickness, they delimit part of the tank 14. The rims 22 extend over a height of 11 m above the support region 20A. The tank 14 thus has, laterally along two sides, flanks which have a total height of 18 m. The total volume of the tank is about 60,000 $m^3$, for a mass of about 7200 t.

The underside of the tank 14 has a valve 26 selectively allowing the inside of the tank 14 and the surrounding marine environment to be placed in free communication.

Furthermore, the inside of the tank 14 is connected by a pipe 27A passing along a leg 12 to an air compressor 27 installed on the barge 10.

The soles 16 are formed of heavy solid blocks. The total mass of the soles is about 6000 t. The height of each sole is roughly 2 m. They are attached under the underside of the tank 14 in its corners. Advantageously, the surface area of the underside of the tank 14, covered by the soles 16, is less than half the total surface area of the underside of the tank. The soles are, for example, in the shape of equilateral triangles with sides 30 m long.

The soles are fixed under the tank 14 by retainers which can be released when the base 17 is placed on the bottom. These retainers for example consist of a mechanical latch or any other appropriate means, for example a wedge fitted through two lugs, one secured to the tank and the other secured to the sole that is to be fixed.

To construct such an oil platform, the first stage is to manufacture the caisson that forms the tank 14. This can then be put afloat.

The barge 10 and the legs 12 are then constructed directly on the central bearing region 20A of the tank while the latter is afloat. Thus, the manufacture of such a platform requires the use of a dry dock only for the initial phase of the construction.

Once the barge 10 and the legs 12 have been completed, the soles 16 are ferried out to the underside of the tank 14. To achieve this, the soles 16 are prefabricated and then submerged and kept near the surface by buoys of an appropriate volume. They are slipped under the corners of the tank 14 and are secured there by the retainers.

To install the platform according to the invention, the successive steps illustrated in FIGS. 2 to 7 are performed.

In the configuration depicted in FIGS. 1 and 2, while the valve 26 is closed and the tank 14 is empty, the barge 10 is kept above sea level. The platform is thus ferried out to the site where it is to be installed.

While it is being transported, the lateral rims 22, which form shields, protect the barge equipped with the production instruments from the waves.

The shields 22 constitute protective freeboards with a height of about 11 meters above sea level, the tank penetrating the water to a depth of about 7 m.

Once the platform production site is reached, the valve 26 in the underside of the tank 14 is opened. Thus, under the action of the total weight of the platform, the latter gradually sinks into the water as the tank 14 fills.

As the tank 14 has no opening in its upper part, the air initially contained therein compresses into one or more air bubbles 30 confined to the upper parts of the tank 14. In particular, the air compresses inside the rims 22 which constitute bell-shaped/inverted U-shaped cavities.

Figure 3:
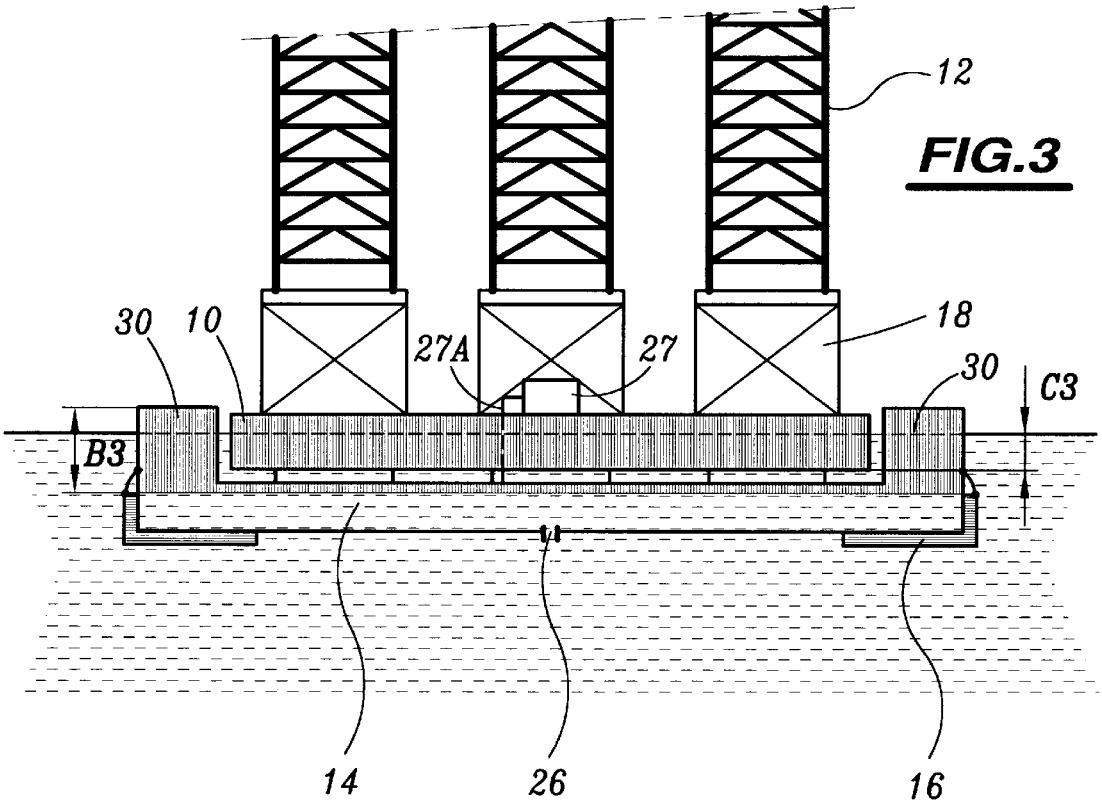
FIGS. 3, 4, 5, 6 and 7 are views in elevation of the platform during successive phases in the installation thereof.

When the pressure in the air bubbles 30 is equal to the pressure of the water in the tank, the platform finds itself in a position of equilibrium as depicted in FIG. 3. In this position, the height of the air bubbles 30 is denoted B3. This height corresponds to the distance separating the upper wall of the rims 22 from the level of liquid in the tank 14. For this height B3 of air bubbles, the volume of air trapped in the tank 14 is about 33,000 $m^3$.

In this position of equilibrium, with the platform sinking into the water, the barge 10 is partially submerged. It thus plays a part in keeping the entire platform buoyant. In particular, in the example being considered, the barge 10 is submerged to a depth denoted C3 of about 5 m.

In this position, the force applied to the lifting mechanisms corresponds to an upwards thrust on the legs under the action of the upthrust applied to the tank 14. This condition corresponds to the point denoted A3 in FIG. 8, where the force is negative.

While the platform is in this position, compressed air is injected into the tank 14.

Figure 8:
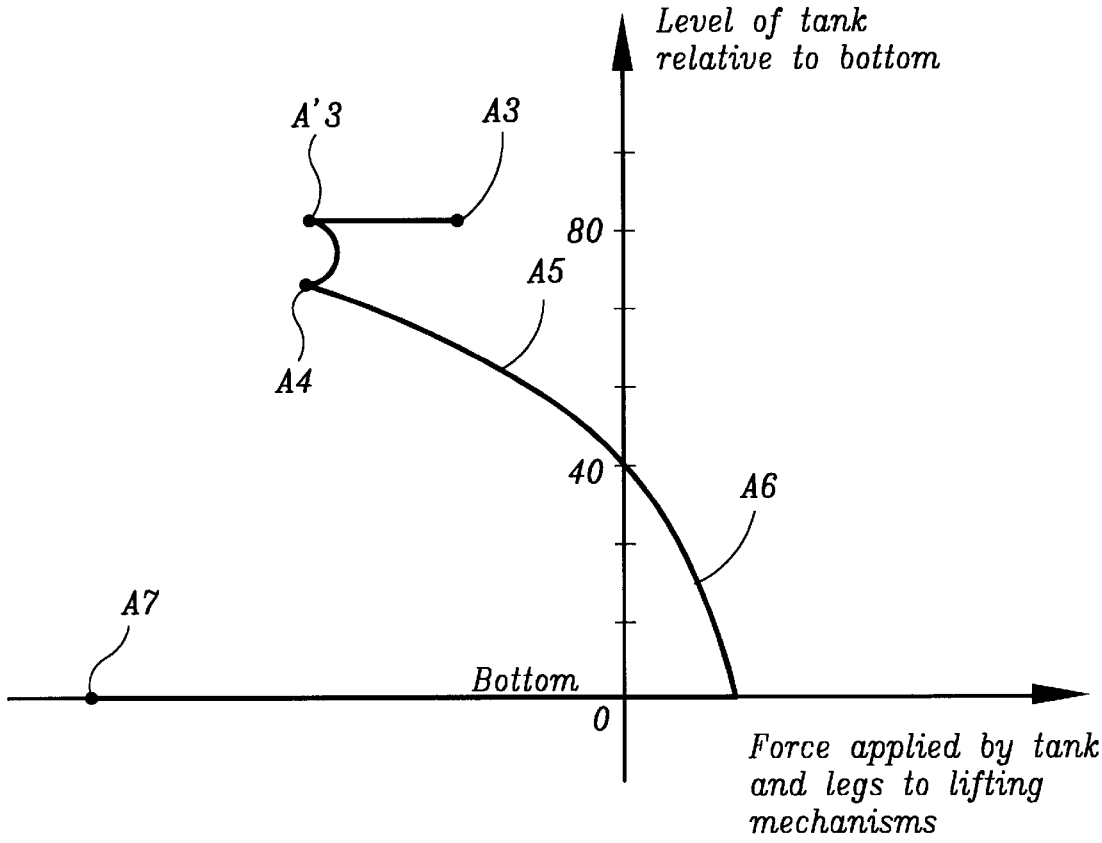
FIG. 8 is a curve representing the force applied to a means of moving the legs as a function of the depth at which the tank is submerged.

Thus, the thrust exerted by the tank 14 via the legs on the lifting mechanisms 18 increases and corresponds to a condition represented by the point A3' in FIG. 8.

In this position, the height of the air bubble B3 is increased and the depth C3 to which the barge 10 is submerged is correspondingly reduced.

The volume of air in the tank is now, for example, 55,000 $m^3$.

From this position, with the valve 26 kept open, a force is applied to the legs 12 using the lifting mechanism 18 which tends to cause the tank 14 to sink.

Figure 4:
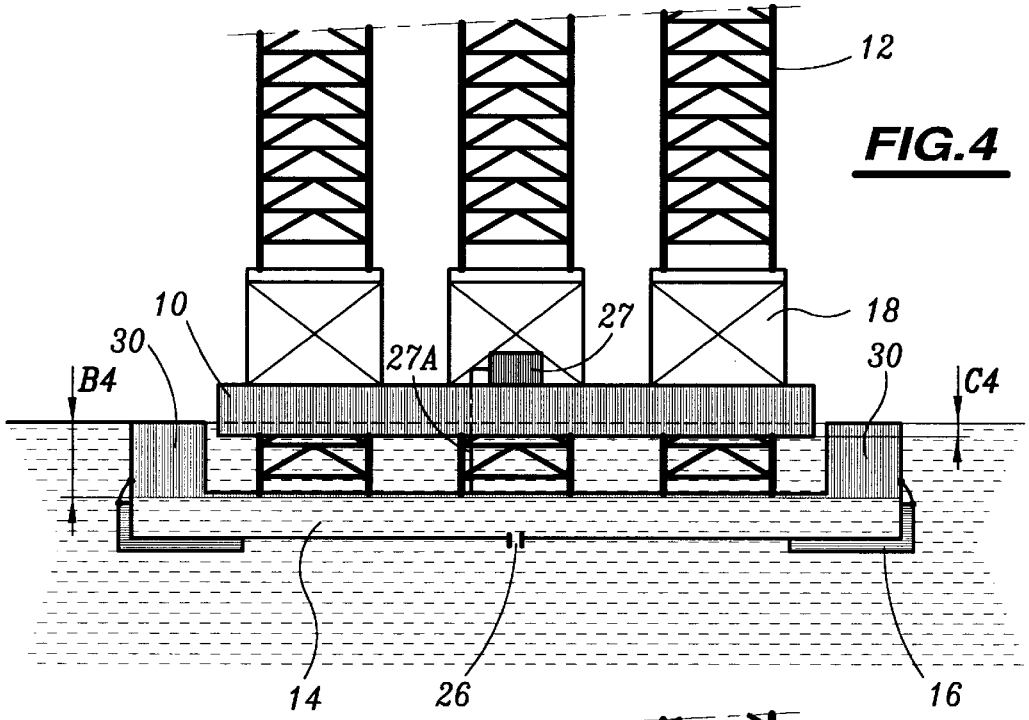

During this sinking, the upper part of the rims 22 break through the surface of the water, so that the entire tank 14 is submerged, as depicted in FIG. 4. In this position, the height B4 of the air bubbles 30 is reduced accordingly. Likewise, the depth C4 to which the barge 10 is submerged is decreased. The latter is, for example, about 1 m. For the depth considered here of the tank 14, the force applied by the lifting means 18 corresponds to the point A4 in FIG. 8.

The tank 14 is lowered slowly enough to guarantee that the pressures outside and inside the tank 14 will reach equilibrium, through water entering the tank 14 through the valve 26. In particular, pauses are observed at regular intervals during the descent.

Figure 5:
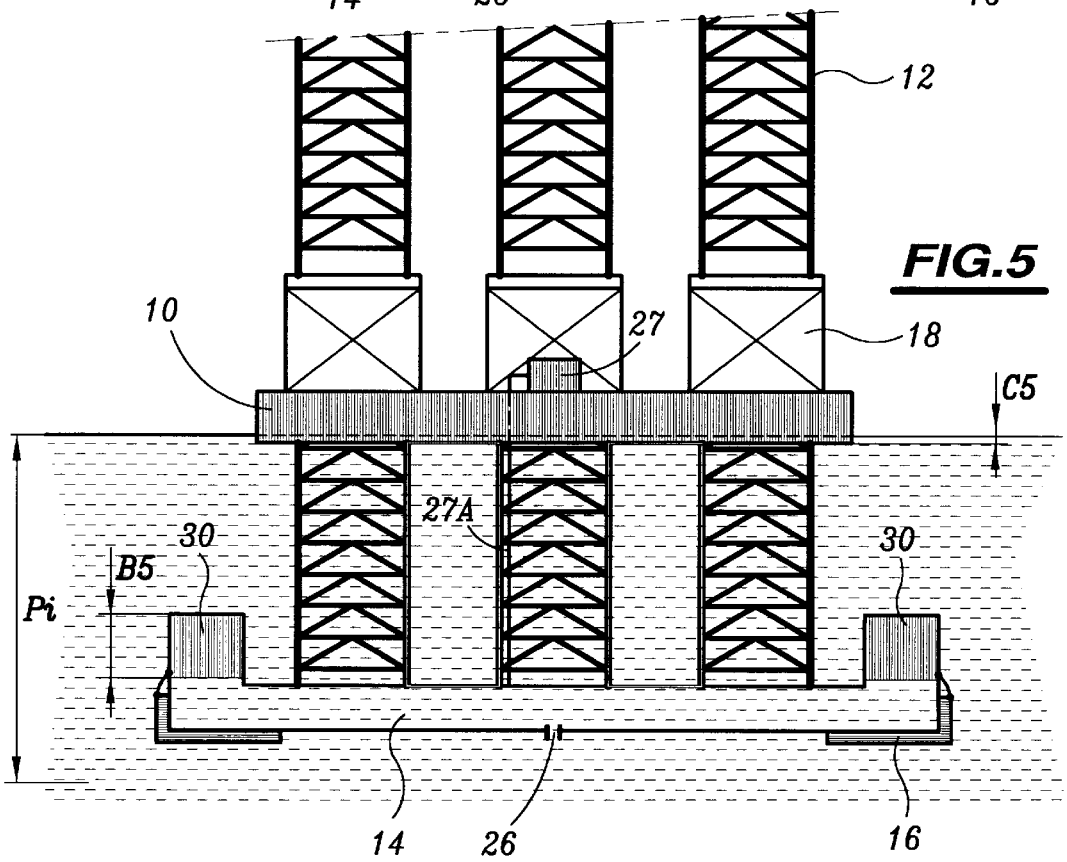

The force applied by the lifting means 18 to the legs 12 to lower the tank 14 continues as depicted in FIG. 5. Thus, as the tank 14 gradually sinks, the height B5 of the air bubbles 30 trapped in the tank 14 decreases. At the same time, the height, denoted C5, by which the barge 10 is submerged, increases.

In FIG. 8, this initial phase of lowering the tank 14 corresponds to the curve portion denoted A5. As depicted in this figure, as the tank 14 gradually sinks, the force applied by the lifting mechanism decreases in terms of absolute value. This is because, since the hydrostatic pressure of the water increases with depth, the volume of air contained in the air bubbles 30 decreases, thus reducing the buoyancy of the tank 14.

For a given depth of submersion, denoted Pi which, in the example in question, is roughly equal to 40 m, the force applied on the lifting mechanisms is cancelled out.

For depths in excess of this depth of submersion Pi, the air bubbles 30 confined in the tank 14 are not enough to make this tank buoyant. So, the tank 14 exerts a pulling force on the legs 12. This pulling force is transmitted to the lifting mechanisms 18 which are then subjected to a positive force, as depicted in FIG. 8 by the curve portion A6.

Figure 6:
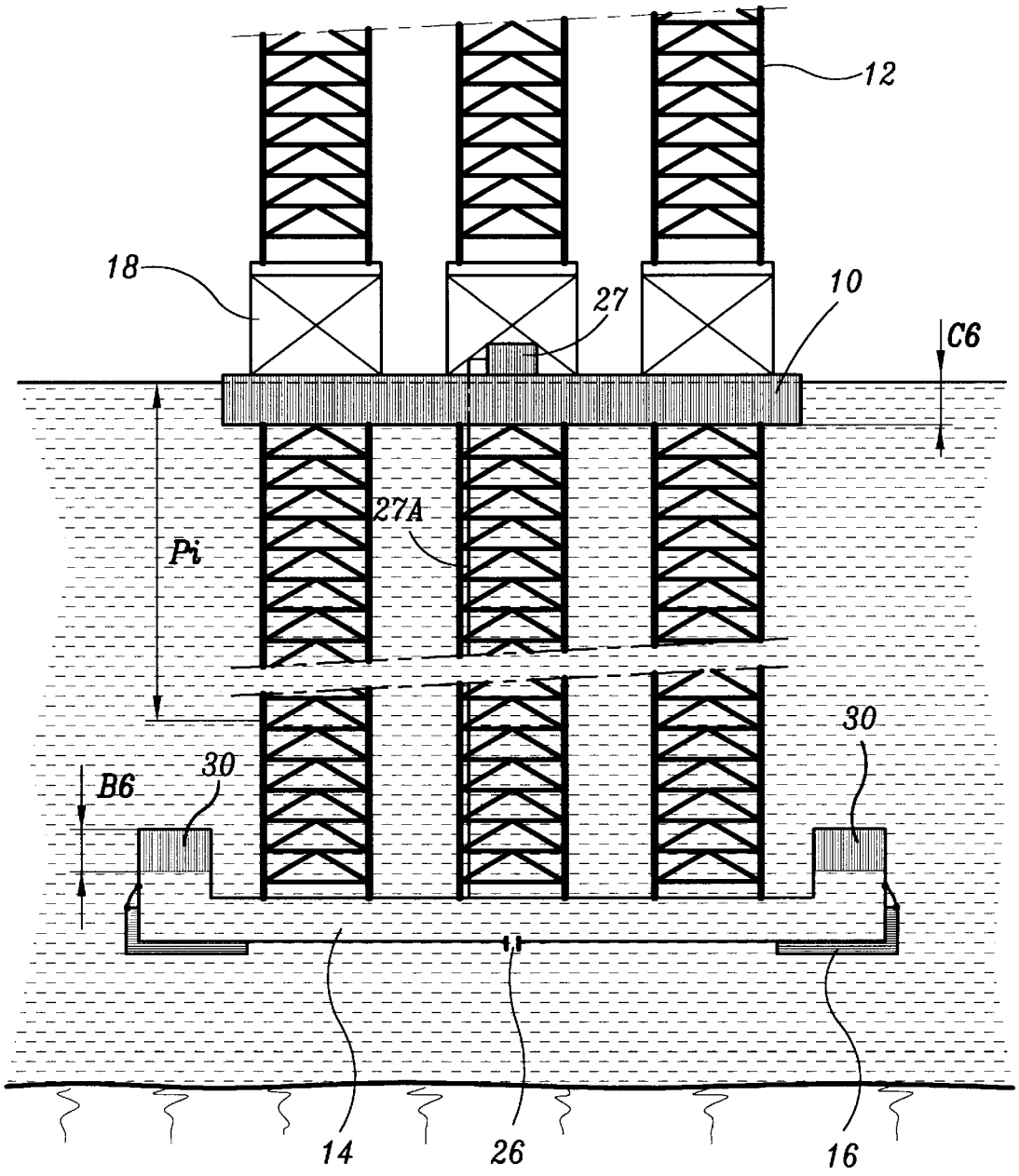
Figure 7:
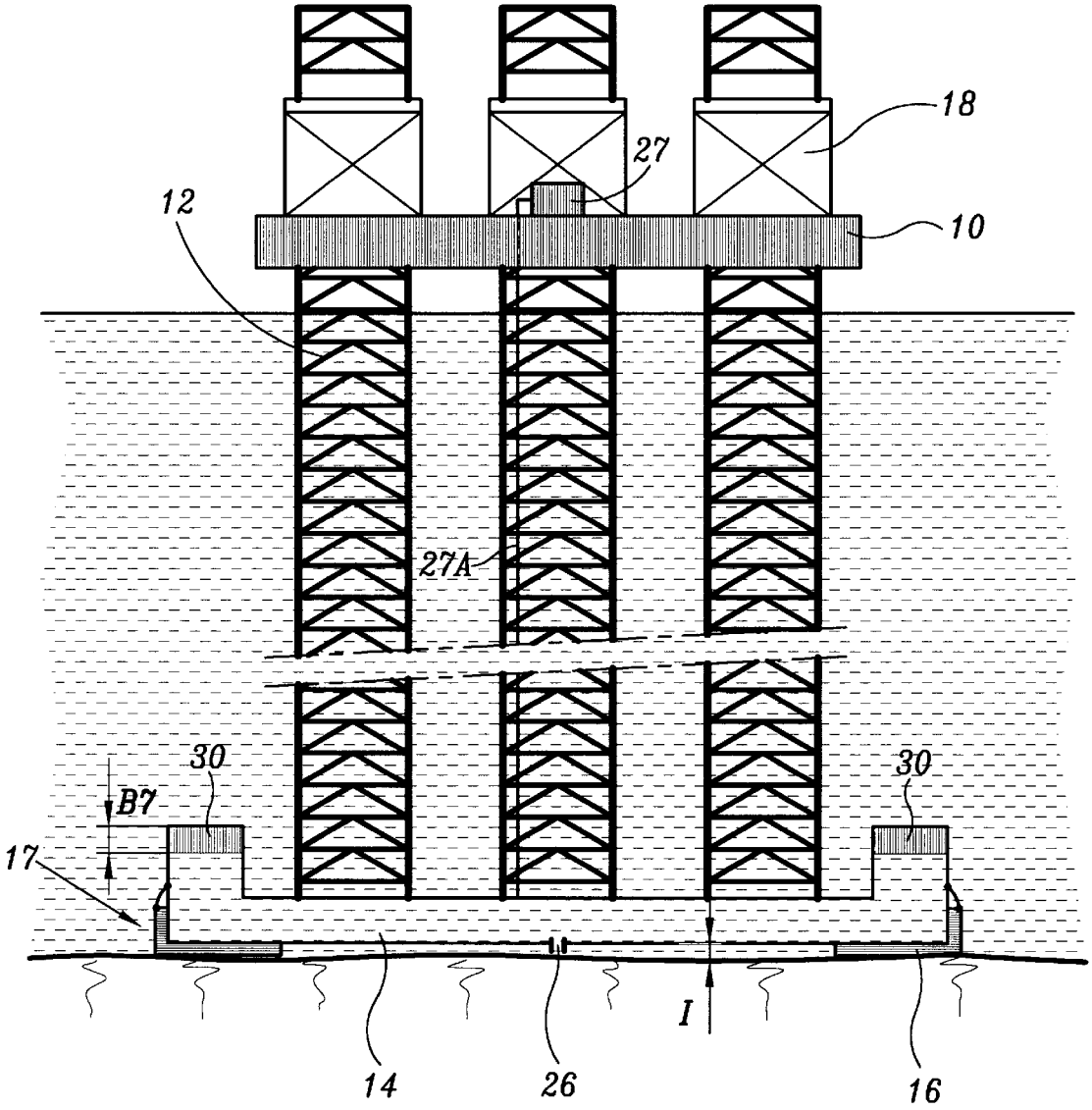

This later phase of lowering the tank 14 corresponds to the phase depicted in FIG. 6, where the height B6 of the air bubbles is reduced. Furthermore, as the legs 12 are exerting a pulling force on the barge 10, the depth, denoted C6, to which this barge is submerged, increases. It is then, for example, on the order of 7 m, when the tank 14 is in close proximity to the floor.

Throughout the phase corresponding to curve portion A6, the barge 10 restrains the tank 14 to prevent the latter from descending too fast. In particular, the lifting mechanisms 18 are released slowly enough to allow the pressures inside and outside the tank 14 to reach equilibrium.

Finally, once the tank 14 has been placed on the bottom via the soles 16, the barge 10 is raised up above sea level. The air contained in the tank is extracted, for example through the vertical pipework installed in the chords of the legs.

The force exerted on the lifting means then corresponds to the point A7 in FIG. 8. In this position, the legs 12 are locked directly to the barge, avoiding prolonged strain on the lifting mechanisms 18.

Once the platform has been installed as indicated earlier, the chamber formed by the tank 14 is used to store the oil extracted by the platform.

It will be understood that throughout the lowering of the tank 14, the pressures inside and outside this tank are more or less always equal, which avoids high stress being applied to the walls of the tank. Thus, these walls can be made of relatively low-thickness plate.

It order to re-site the oil platform, it needs to be returned to its transport position depicted in FIG. 2.

To do this, the steps followed for lowering the tank 14 are reproduced in the reverse order.

In particular, an air bubble with a height B7 is first of all injected into the tank.

A pulling force is then exerted on the legs 12 using the lifting mechanisms 18. This pulling force is exerted until such time as the tank 14 reaches the submersion depth Pi.

Next, the tank 14 tends to rise to the surface of its own accord. To limit the speed at which it rises, the lifting mechanisms 18 exert thrust on the legs 12 so that they force the tank downwards. In this configuration, the barge 10 weighs down on the tank.

Thus, the raising speed can be reduced so that at every moment the pressure difference between the inside and the outside of the tank is practically zero.

Observing decompression steps allows water to flow satisfactorily through the valve 26 so that the pressure in the tank 14 is equal to the hydrostatic pressure at the depth to which the tank is submerged.

Thus, in every circumstance, be this during installation, operation or dismantling, the tank is in pressure equilibrium.

Furthermore, with a platform as described here, the force applied to the lifting mechanisms is relatively low for installing a large-capacity tank.

What is more, when lowering and raising the tank, this tank acts as a stabilizer for the barge floating on the water.

During manufacture, the special shape of the tank allows it to act as a floating dock which makes it possible for the barge and the legs to be manufactured directly on the floating tank.

Under certain particularly arduous conditions, particularly when the sea bed is unstable, there is a risk that the underside of the base 17 may stick to the bottom.

In this case, before raising the tank 14, the retainers 19 that secure the tank 14 to at least some soles 16 are released. This release may be performed, for example, by a diver. Thus, some of the soles 16 remain on the bottom, allowing the tank 14 to be raised.

The situation is that, because of the thickness of the soles 16, when the base 17 is placed on the bottom, the central region of the tank 14 is spaced away from the bottom by a space I (FIG. 7) about 2 m tall. Thus, the surface of the underside of the tank 14 is not held firmly against the bottom by sticking and the tank can therefore be raised.

Such soles may be used with any type of tank or submerged element intended to rest on the bottom of the sea and then be raised back up to the surface.

What is claimed is:

1. A jack-up platform comprising:

a plurality of bearing legs having lower ends, respectively;

a buoyant upper barge mounted so as to be movable along the length of said bearing legs;

mechanical moving means for moving said bearing legs relative to said upper barge; and a submersible storage tank connected to the lower ends of said bearing legs so that said storage tank can be moved by said mechanical means relative to said upper barge, said storage tank having a lower opening for selectively permitting an interior of said storage tank to be placed in free communication with a body of water, said storage tank being adapted to rest on a surface below the body of water, wherein an upper portion of said storage tank defines a cavity having an inverted U-shaped cross-section for confining an air pocket therein, and wherein said mechanical means are operable to apply a force on said bearing legs in order to cause said storage tank to sink, and to apply an opposite force on said bearing legs to cause said storage tank to rise.

2. A jack-up platform as claimed in claim 1, further comprising means for injecting gas under pressure into said storage tank.

3. A jack-up platform as claimed in claim 1, wherein said storage tank comprises:

a base having a surface area that is at least equal to a surface area of said upper barge; and at least one upper shield partially surrounding said base and extending along said upper barge when said upper barge is in close proximity to said base.

4. A jack-up platform as claimed in claim 3, wherein said shield forms part of said storage tank.

5. A jack-up platform as claimed in claim 1, wherein said storage tank comprises:

a base having a surface area that is at least equal to a surface area of said upper barge; and a plurality of upper shields partially surrounding said base and extending along said upper barge when said upper barge is disposed in close proximity to said base, wherein said storage tank defines a substantially polygonal shape, and said shields extend along most of the length of at least two sides of said base.

6. A jack-up platform as claimed in claim 1, further comprising a valve positioned in said lower opening of said storage tank.

7. A jack-up platform as claimed in claim 1, further comprising:

at least one sole member; and at least one retainer securing said sole member to an underside of said storage tank, such that, when said storage tank is resting on the surface below the body of water via said sole member, said retainer can be released to allow said storage tank to rise without said sole member.

8. A jack-up platform as claimed in claim 7, wherein said sole member covers a portion of the underside of said storage tank and the surface area of the underside covered by said sole member is less than half of the total surface area of the underside of said storage tank.

9. A jack-up platform as claimed in claim 7, wherein said sole member, when attached to said storage tank, substantially conforms to an adjacent external contour of said storage tank, said sole member being positioned such that a central region of said storage tank is exposed.

10. A jack-up platform as claimed in claim 7, wherein a height of said sole member maintaining a space between the surface below the body of water and a region of the underside of said storage tank that is not covered with said sole member.

11. A jack-up platform as claimed in claim 1, further comprising:

a plurality of sole members adapted to rest on the surface below the body of water;

a plurality of retainers securing said sole members, respectively, to an underside of said storage tank, such that, when said storage tank is resting on the surface below the body of water via said sole members, said retainers can be released to allow said storage tank to rise in the body of water without said sole members attached thereto, wherein said sole members cover a portion of the underside of said storage tank so that the surface area of the underside that is covered by said sole members is less than half of the total surface area of the underside of said storage tank, wherein said sole members, when attached to said storage tank, generally conform to adjacent external contours of said storage tank, said sole members being positioned such that a central region of said storage tank is exposed; and wherein a height of each of said sole members maintaing a space between the surface below the body of water and a region of the underside of said storage tank that is not covered with said sole members.

12. A jack-up platform as claimed in claim 11, wherein said sole members are disposed so that said upper barge nests with said storage tank when said legs are in a raised position relative to said upper barge.

13. A method of installing a submerged tank of a jack-up platform that includes a plurality of bearing legs, a buoyant upper barge mounted so as to be movable along the length of the bearing legs; mechanical moving means for moving the bearing legs relative to the upper barge; and a submersible storage tank connected to the bearing legs so that the storage tank can be moved by the mechanical means relative to the upper barge, the method comprising:

placing the storage tank in free communication with a marine environment via a lower opening so that the pressure of air trapped within the tank and the pressure of water reach equilibrium, wherein said tank initially only has its own weight acting thereon;

progressively lowering the legs relative to the upper barge, which is kept constantly afloat, by action of the mechanical means and by gradually allowing the water to enter the storage tank through the lower opening such that the pressure in the storage tank is kept substantially equal to the hydrostatic pressure at any depth of the storage tank; and jacking up the upper barge above an upper surface of the water once the storage tank is supported on a surface below the water, wherein the upper barge is jacked up above the upper surface of the water by moving the upper barge relative to the legs.

14. The method as claimed in claim 13, wherein the method further comprises injecting gas into the storage tank before the legs are lowered relative to the upper barge.

15. The method as claimed in claim 13, wherein, as the legs are being lowered during an initial phase, the mechanical means are operated to force the legs downward, and, during a later phase, the mechanical means are operated to restrain the legs from descending with the tank.

16. The method as claimed in claim 13, further comprising pausing the lowering operation of the legs in order to allow the pressure inside the storage tank and the pressure outside of the storage tank to reach equilibrium by the water entering the storage tank.

17. A method of raising a submerged tank of a jack-up platform having a plurality of bearing legs, a buoyant upper barge mounted so as to be movable along the length of the bearing legs, mechanical moving means for moving the bearing legs relative to the upper barge, and a submersible storage tank connected to the bearing legs so that the storage tank can be moved by the mechanical moving means relative to the upper barge, the method comprising:

placing the storage tank in free communication with a body of water via a lower opening in the storage tank such that air is trapped in an air pocket inside of the storage tank, wherein the pressure of the air in the air pocket is equal to the hydrostatic pressure at the depth of the storage tank; and raising the bearing legs gradually relative to the upper barge, which is kept constantly afloat, by action of the mechanical means and by allowing water to gradually leave the storage tank, thus keeping the pressure in the storage tank substantially equal to the hydrostatic pressure at the depth of the storage tank.

18. The method as claimed in claim 17, further comprising injecting gas into the storage tank prior to the raising of the legs.

19. The method as claimed in claim 17, further comprising controlling the volume of the air pocket such that, when raising the legs during an initial phase, the mechanical means are operating to force the legs upwards, and, during a later phase, the mechanical means are operating to restrain the raising of the legs which are being thrust upwardly by the storage tank.

20. The method as claimed in claim 17, further comprising pausing the operation of raising the legs so as to allow the pressure inside of the storage tank and the pressure outside of the storage tank to reach equilibrium due to the water leaving the storage tank.

21. The method as claimed in claim 17, further comprising releasing a plurality of sole members secured to a lower surface of said storage tank to permit the storage tank to rise without the sole members.

* * * * *